US009515363B2

(12) United States Patent
Herbsommer

(10) Patent No.: US 9,515,363 B2
(45) Date of Patent: Dec. 6, 2016

(54) DIELECTRIC WAVEGUIDE (DWG) FILTER HAVING CURVED FIRST AND SECOND DWG BRANCHES WHERE THE FIRST BRANCH FORMS A DELAY LINE THAT REJOINS THE SECOND BRANCH

(71) Applicant: Texas Instruments Incorporated, Dallas, TX (US)

(72) Inventor: Juan Alejandro Herbsommer, Allen, TX (US)

(73) Assignee: TEXAS INSTRUMENTS INCORPORATED, Dallas, TX (US)

( * ) Notice: Subject to any disclaimer, the term of this patent is extended or adjusted under 35 U.S.C. 154(b) by 57 days.

(21) Appl. No.: 14/574,363

(22) Filed: Dec. 17, 2014

(65) Prior Publication Data

US 2015/0295299 A1 Oct. 15, 2015

Related U.S. Application Data

(60) Provisional application No. 61/977,403, filed on Apr. 9, 2014.

(51) Int. Cl.
*H01P 1/213* (2006.01)
*H01P 3/16* (2006.01)
(Continued)

(52) U.S. Cl.
CPC ..... *H01P 1/213* (2013.01); *H01P 1/2002* (2013.01); *H01P 3/122* (2013.01); *H01P 3/16* (2013.01); *H01P 5/12* (2013.01)

(58) Field of Classification Search
CPC ..... H01P 1/213; H01P 1/2138; H01P 3/16; H01P 3/165; H01P 3/18; H01P 1/2002
(Continued)

(56) References Cited

U.S. PATENT DOCUMENTS 2,258,148 A * 10/1941 Schussler ..... H01P 1/213 333/206
3,042,883 A * 7/1962 Pannenborg et al. ... H01P 1/209 333/110
(Continued)

FOREIGN PATENT DOCUMENTS

GB 776971 A 6/1957
WO 02089116 A1 11/2002

OTHER PUBLICATIONS

"3D Printing", Wikipedia, pp. 1-35, available at http://en.wikipedia.org/w/index.php?title=3D_printing&oldid=624190184 on Sep. 4, 2014.
(Continued)

*Primary Examiner* — Benny Lee
(74) *Attorney, Agent, or Firm* — John R. Pessetto; Charles A. Brill; Frank D. Cimino

(57) ABSTRACT

Signals on a dielectric waveguide are filtered to pass or block selected frequencies. A combined signal is received in the DWG, wherein the combined signal comprises at least a first frequency signal with a first wavelength and a second frequency signal with a second wavelength. The combined signal is split into a first portion and a second portion. The first portion of the combined signal is delayed by an amount of delay time to form a delayed first portion. The delayed first portion is joined with the received combined signal to form a filtered signal such that the first frequency signal is enhanced by constructive interference while the second frequency signal is diminished by destructive interference. A portion of the filtered signal is provided to a receiver, whereby the amplitude of the second frequency signal is attenuated in the filtered signal.

18 Claims, 9 Drawing Sheets

(51) Int. Cl.
*H01P 1/20* (2006.01)
*H01P 3/12* (2006.01)
*H01P 5/12* (2006.01)

(58) Field of Classification Search
USPC ..... 333/135, 208
See application file for complete search history.

(56) References Cited

U.S. PATENT DOCUMENTS

| | | | | |
|---|---|---|---|---|
| 3,092,790 | A * | 6/1963 | Leake et al. ..... | H01P 1/16 333/110 |
| 4,091,343 | A * | 5/1978 | Knox et al. ..... | H01P 1/16 333/113 |
| 6,111,485 | A | 8/2000 | Carlson et al. | |
| 2014/0285277 | A1 | 9/2014 | Herbsommer | |

OTHER PUBLICATIONS

Juan Alejandro Herbsommer, "Dielectric Waveguide Signal Divider", U.S. Appl. No. 14/498,512, filed Sep. 26, 2014, pp. 1-24.

* cited by examiner

DIELECTRIC WAVEGUIDE (DWG) FILTER HAVING CURVED FIRST AND SECOND DWG BRANCHES WHERE THE FIRST BRANCH FORMS A DELAY LINE THAT REJOINS THE SECOND BRANCH

CLAIM OF PRIORITY UNDER 35 U.S.C. 119(e)

The present application claims priority to and incorporates by reference U.S. Provisional Application No. 61/977,403 filed Apr. 9, 2014, entitled "Frequency Selector for Mm-Wave Communication Using a Dielectric Waveguide."

FIELD OF THE INVENTION

This invention generally relates to wave guides for high frequency signals, and in particular to waveguides with dielectric cores.

BACKGROUND OF THE INVENTION

In electromagnetic and communications engineering, the term "waveguide" may refer to any linear structure that conveys electromagnetic waves between endpoints thereof. The original and most common meaning is a hollow metal pipe used to carry radio waves. This type of waveguide is used as a transmission line for such purposes as connecting microwave transmitters and receivers to antennas, in equipment such as microwave ovens, radar sets, satellite communications, and microwave radio links.

A dielectric waveguide employs a solid dielectric core rather than a hollow pipe. A dielectric is an electrical insulator that can be polarized by an applied electric field. When a dielectric is placed in an electric field, electric charges do not flow through the material as they do in a conductor, but only slightly shift from their average equilibrium positions causing dielectric polarization. Because of dielectric polarization, positive charges are displaced toward the field and negative charges shift in the opposite direction. This creates an internal electric field which reduces the overall field within the dielectric itself. If a dielectric is composed of weakly bonded molecules, those molecules not only become polarized, but also reorient so that their symmetry axis aligns to the field. While the term "insulator" implies low electrical conduction, "dielectric" is typically used to describe materials with a high polarizability; which is expressed by a number called the "relative permittivity ($\in k$)." The term "insulator" is generally used to indicate electrical obstruction while the term "dielectric" is used to indicate the energy storing capacity of the material by means of polarization.

Permittivity is a material property that expresses a measure of the energy storage per unit meter of a material due to electric polarization $(J/V^2)/(m)$. Relative permittivity is the factor by which the electric field between the charges is decreased or increased relative to vacuum. Permittivity is typically represented by the Greek letter $\in$. Relative permittivity is also commonly known as dielectric constant.

Permeability is the measure of the ability of a material to support the formation of a magnetic field within the material in response to an applied magnetic field. Magnetic permeability is typically represented by the Greek letter $\mu$.

The electromagnetic waves in a metal-pipe waveguide may be imagined as travelling down the guide in a zig-zag path, being repeatedly reflected between opposite walls of the guide. For the particular case of a rectangular waveguide, it is possible to base an exact analysis on this view.

Propagation in a dielectric waveguide may be viewed in the same way, with the waves confined to the dielectric by total internal reflection at the surface thereof.

BRIEF DESCRIPTION OF THE DRAWINGS

Particular embodiments in accordance with the invention will now be described, by way of example only, and with reference to the accompanying drawings.

Figure 1:
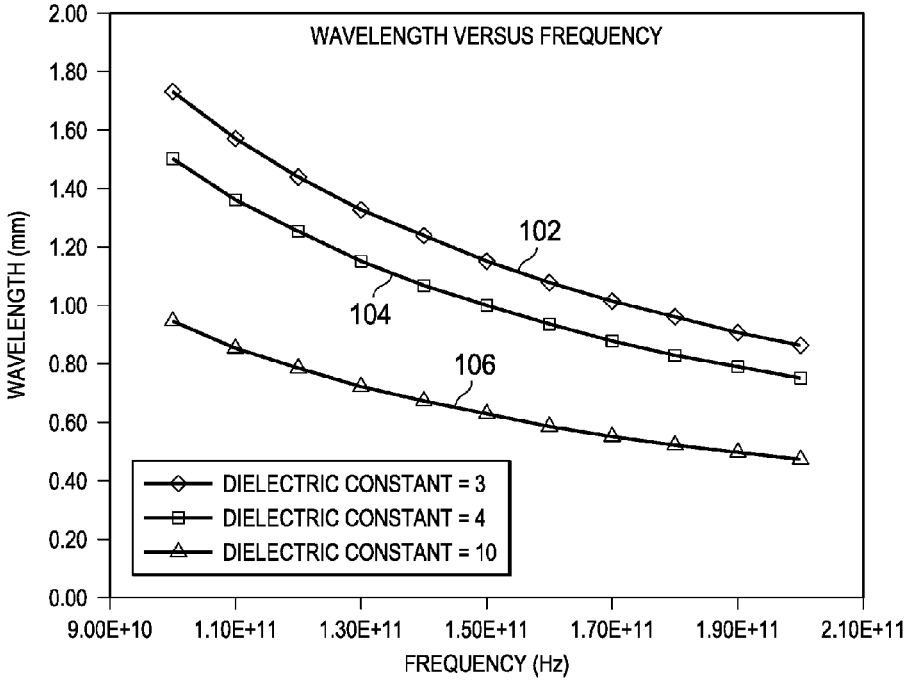
FIG. 1 is a plot of wavelength versus frequency through materials of various dielectric constants.

Other features of the present embodiments will be apparent from the accompanying drawings and from the detailed description that follows.

DETAILED DESCRIPTION OF EMBODIMENTS OF THE INVENTION

Specific embodiments of the invention will now be described in detail with reference to the accompanying figures. Like elements in the various figures are denoted by like reference numerals for consistency. In the following detailed description of embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

A dielectric waveguide (DWG) may be used as an interconnect to communicate chip to chip in a system or system to system, for example. In order to maximize the amount of data transmitted, information may be transmitted in different frequencies or channels. Embodiments of the invention provide a way to filter and select the information in different frequencies or channels of communication being transmitted through a dielectric waveguide by using a DWG frequency selector device, as will be described in more detail below.

As frequencies in electronic components and systems increase, the wavelength decreases in a corresponding manner. For example, many computer processors now operate in the gigahertz realm. As operating frequencies increase to the sub-terahertz (THz) realm, the wavelengths become short enough that signal lines that exceed a short distance may act as an antenna and signal radiation may occur. FIG. 1 is a plot of wavelength in mm versus frequency in Hz through materials of various dielectric constants. As illustrated by plot 102 which represents a material with a low dielectric constant of 3, such as a printed circuit board, a 100 GHz signal will have a wavelength λ of approximately 1.7 mm. Thus, a signal line that is only 1.7 mm in length may act as a full wave antenna and radiate a significant percentage of the signal energy. In fact, even lines of λ/10 are good radiators, therefore a line as short as 170 um may act as a good antenna at this frequency. Plot line 104 represents a material that has a dielectric constant of 4. Plot line 106 represents a material that has a higher dielectric constant of 10. As can be seen from plot lines 104, 106, materials having higher dielectric constant will allow radiation at even shorter lengths of signal lines.

Waves in open space propagate in all directions, as spherical waves. In this way they lose their power proportionally to the square of the distance; that is, at a distance R from the source, the power is the source power divided by $R^2$. A wave guide may be used to transport high frequency signals over relatively long distances. The waveguide confines the wave to propagation in one dimension, so that under ideal conditions the wave loses no power while propagating. Electromagnetic wave propagation along the axis of the waveguide is described by the wave equation, which is derived from Maxwell's equations, and where the wavelength depends upon the structure of the waveguide, and the material therewithin (air, plastic, vacuum, etc.), as well as on the frequency of the electromagnetic wave. Commonly-used waveguides are only of a few categories. The most common kind of waveguide is one that has a rectangular cross-section, one that is usually not square. It is common for the long side of this cross-section to be twice as long as its short side. These are useful for carrying electromagnetic waves that are horizontally or vertically polarized.

A waveguide configuration may have a core member made from dielectric material with a high dielectric constant and be surrounded with a cladding made from dielectric material with a lower dielectric constant. While theoretically, air could be used in place of the cladding, since air has a dielectric constant of approximately 1.0, any contact by humans, or other objects may introduce serious impedance mismatch effects that may result in signal loss or corruption. Therefore, typically free air does not provide a suitable cladding.

For the exceedingly small wavelengths encountered for sub-THz radio frequency (RF) signals, dielectric waveguides perform well and are much less expensive to fabricate than hollow metal waveguides. Furthermore, a metallic waveguide has a frequency cutoff determined by the size of the waveguide. Below the cutoff frequency there is no propagation of the electromagnetic field. Dielectric waveguides may have a wider range of operation without a fixed cutoff point. However, a purely dielectric waveguide may be subject to interference caused by touching by fingers or hands, or by other conductive objects. Metallic waveguides confine all fields and therefore do not suffer from EMI (electromagnetic interference) and cross-talk issues; therefore, a dielectric waveguide with a metallic cladding may provide significant isolation from external sources of interference. Various types of dielectric core waveguides will be described in more detail below.

Various configurations of dielectric waveguides (DWG) and interconnect schemes are described in US Patent Publication number 2014-0285277, filed Apr. 1, 2013, entitled "Dielectric Waveguide Manufactured Using Printed Circuit Board Technology" and are incorporated by reference herein. Various antenna configurations for launching and receiving radio frequency signals to/from a DWG are also described therein and are incorporated by reference herein.

Figure 2:
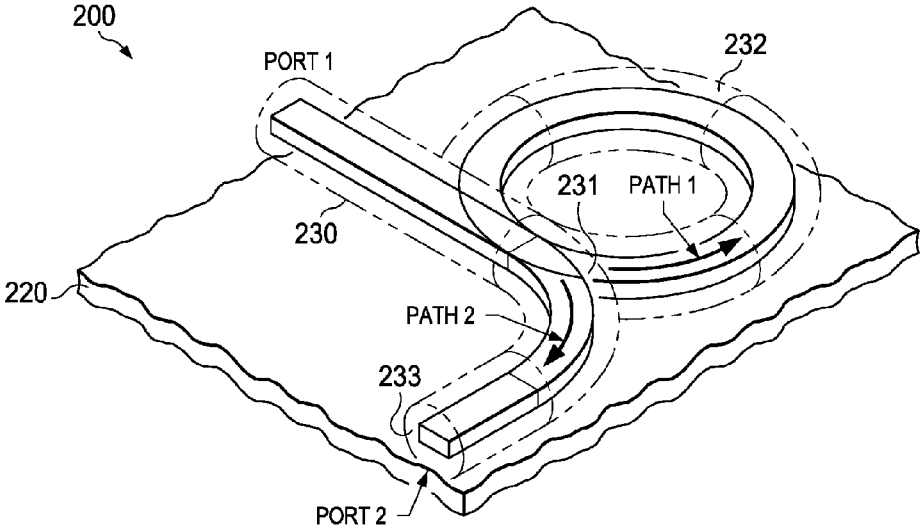
FIG. 2 is an illustration of a dielectric waveguide frequency selector.

FIG. 2 is an isometric illustration of a dielectric waveguide frequency selector device 200. In this example, an integrated circuit (IC) (not shown) may include a high frequency circuitry that produces a signal that is connected to a launching mechanism, such as a dipole antenna, that is configured to launch an electromagnetic signal into an adjacent DWG that is coupled to frequency selector device 200. In this example, frequency selector device 200 may be formed on a substrate 220. Substrate 220 may be part of the IC, or the IC may be mounted on substrate 220, for example.

DWG frequency selector 200 has an input DWG portion 230 that is configured to receive a high frequency signal launched into port 1. Input DWG 230 is bifurcated in region 231 to form a circular DWG portion 232 and an output DWG portion 233 that is configured to propagate a high frequency signal out of port 2. In this example, the radius of curvature of path 1 leading to circular DWG portion 232 and the radius of curvature of path 2 leading to output DWG portion 233 are approximately equal.

A combined high frequency signal that has different frequency signals may be launched into port 1 of frequency selector 200 from the high frequency circuitry of an IC that is coupled to frequency selector device 200. At bifurcation region 231, the signal divides into two different paths of equal or similar strength. In order for these two signals to have similar strengths the radius of curvature of the DWG of path 1 and path 2 may be approximately the same. For example, if path 2 was to continue straight with no bend with respect to port 1, most of the signal would continue through path 2 and almost no signal would travel through path 1. However, in another embodiment, a different radius may be used for path 1 and for path 2 in order to cause the signal to bifurcate in an unequal manner.

Another design consideration is that the dielectric constant of the DWG core needs to be substantially higher than the dielectric constant of the cladding that surrounds the core. If this is not the case, then an electromagnetic wave travelling from port 1 will have the tendency to keep moving in a straight manner leaving the DWG. In this example, the dielectric constant of the core is approximately 5 while the dielectric constant of the cladding is less than approximately 2.

Figure 3:
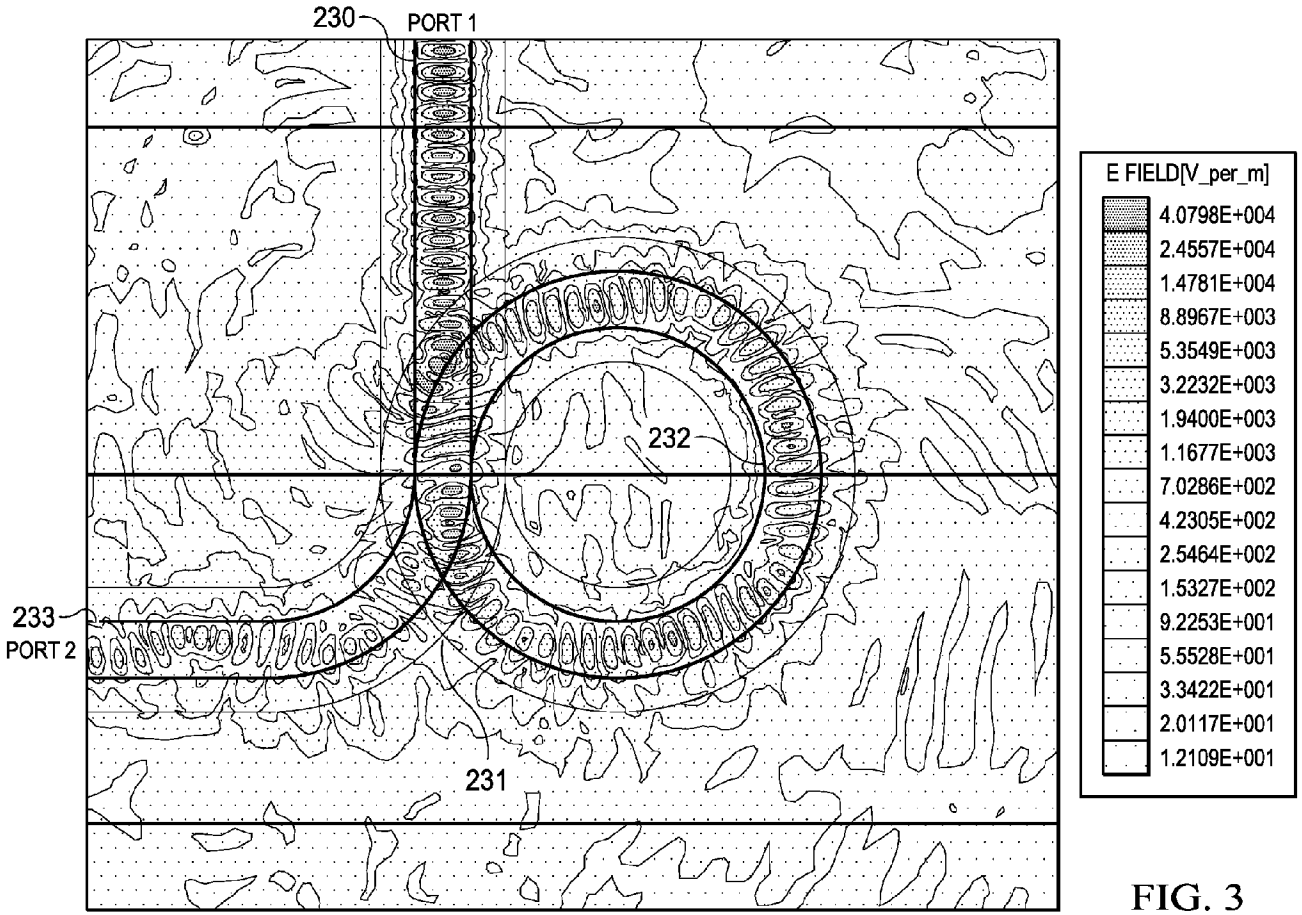
FIG. 3 is a simulation illustrating signal wave interaction in the selector of FIG. 2.

FIG. 3 illustrates a finite element simulation of the propagation of an electromagnetic (EM) wave through the DWG frequency selector of FIG. 2. Filtering effects occur when the electromagnetic wave of path 1 goes around the circular path 232 and rejoins the electromagnetic wave coming from port 1 on input DWG portion 230. Depending the frequency (or wavelength) of the electromagnetic wave and the length of the circular path 232, the signal will interfere constructively or destructively with the signal coming from port 1 to form the signal that is propagated out of port 2.

The condition for constructive interference is given by equation (1) and the condition for destructive interference is given by equation (2).

$$\text{Circular path length} = n * \text{EM1 wavelength, where } n=1,2,3,4 \quad (1)$$

$$\text{Circular path length} = (n+1/2) * \text{EM2 wavelength, where } n=1,2,3,4 \quad (2)$$

For a given circular path length, equations (1) and (2) may be combined to form equation (3) to determine a relationship between EM wavelengths that undergo constructive interference and destructive interference.

$$n*\text{EM1 wavelength}=(n+1/2)*\text{EM2 wavelength}$$

$$\text{EM1 wavelength}=((n+1/2)/n)*\text{EM2 wavelength} \quad (3)$$

Figure 4:
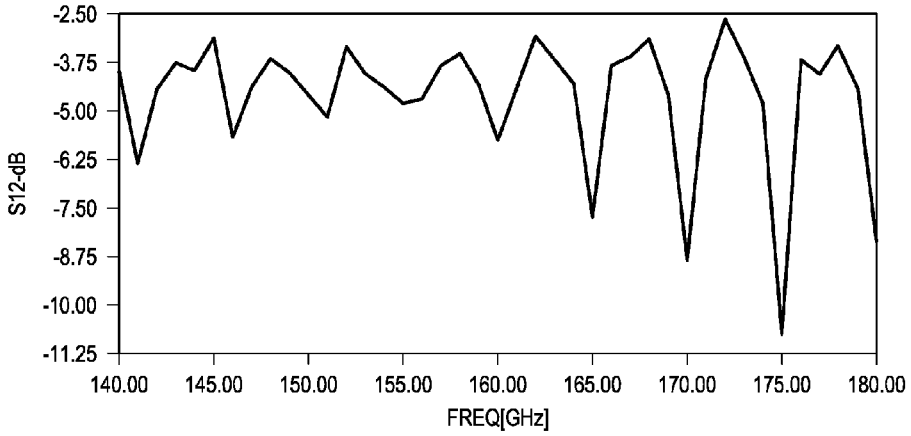
FIG. 4 is an example plot of S-parameters for the frequency selector of FIG. 2.

FIG. 4 is an example plot of S-parameters for the frequency selector of FIG. 2, showing S12 insertion loss in dB vs frequency in GHz for the simulation illustrated in FIG. 3. In this example, based on equation (3) a circular path length is selected such that n=32. Thus, when EM1 equals 160 GHz, EM2 equals 162.5 GHz, according to equation (3). Thus, in this example, a modulation with approximately 5 GHz frequency is illustrated that corresponds to constructive interference and destructive interference at different frequencies. Frequencies such as 160, 165, 170 . . . GHz show a dip in the S12 parameter indicating that at these frequencies there is a destructive interference produced by the filter device 200. Frequencies such as 162.5, 167.5, and 172.5 . . . show a much lower insertion loss indicating that the device is creating a constructive interference.

In this example, device 200 will act as a comb filter and filter out frequencies of approximately 160, 165, 170 . . . GHz, for example, when the length of the circular path is selected such that n=32. Thus, the length factor "n" of the circular path may be selected to determine the spacing of the teeth in the comb filter, according to equation (3), for example.

While equations 1-3 are based on a circular path length and wavelength of the signals, a similar set of equations may be derived for a time delay imposed on the signals based on the period of the signals. Each wavelength has a corresponding time period for the duration of one wavelength being transmitted through the DWG. Another embodiment may use other known or later developed means to delay a portion of the signal for a specified amount of time, such as a delay line, for example.

In this example, the plot of insertion loss S12 indicates a loss of at approximately 2.5 db for the constructive interference signals. The 2.5 dB of loss includes bending loss and other losses from the entire device. The losses are due to the signal that is coming out of the DWG and from the intrinsic loss of the materials (attenuation due to the loss tangent of the polymers of the core and cladding). The minimum diameter of delay loop 232 depends on the characteristics of the core and cladding. The bigger the contrast between the dielectric constant of the core and cladding, the lower will be the bending losses. In some embodiments, metallic or otherwise conductive cladding may be added to the outside of the curved DWG that may reduce the bending losses.

Figure 5:
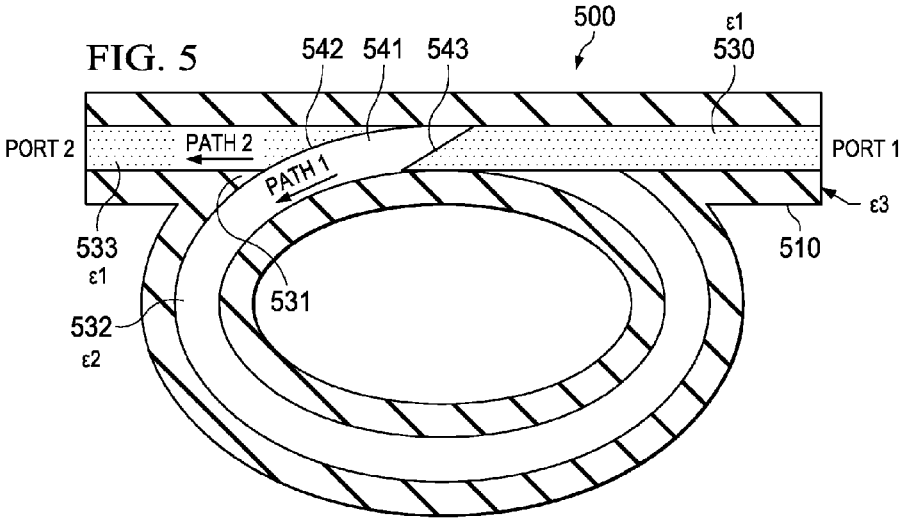
FIGS. 5-6 illustrate alternative embodiments of a waveguide frequency selector.

FIG. 5 illustrates an alternative embodiment of a waveguide frequency selector device 500. DWG filter 500 has an input DWG portion 530 that is configured to receive a high frequency signal launched into port 1. Input DWG 530 is bifurcated in region 531 to form a circular DWG portion 532 and an output DWG portion 533 that is configured to propagate a high frequency signal out of port 2. In this example, output DWG portion 533 may be approximately straight rather than curved. In order to cause a significant amount of signal to bifurcate through the bent portion of filter 500 and feed circular DWG portion 532, the signal filter may use two different materials for the core. In this example, the magnitude of the electromagnetic field in path 1 and path 2 is controlled by the selection of two different dielectric constant materials for the core. This device has a core and cladding made of different polymers as will be explained in more detail below. Additionally, in this case the device is made of two different cores materials and only one cladding polymer. Core portions 530, 533 are implemented with a core material having dielectric constant $\in$1 and core portion 541 is implemented with a polymer having dielectric constant $\in$2. Cladding 510 has a dielectric constant $\in$3, which as will be explained in more detail below, has a value that is less than $\in$1 and $\in$2. In general, in order to produce a significant signal strength on path 1, the divider is designed with $\in$2>$\in$1 in order to overcome the tendency of the electromagnetic wave to keep moving straight from port 1 to port 2. Various configurations of dielectric waveguide signal divider schemes are described in more detail in U.S. patent application Ser. No. 14/498,512 filed Sep. 26, 2014, entitled "Dielectric Waveguide Signal Divider" which is incorporated by reference herein.

In order to minimize the impedance mismatch between the different dielectric core materials, a taper or smooth transition region 543 is provided between the materials with dielectric constants $\in$1 and $\in$2. In this example, the taper is linear; however, in another embodiment the taper may be non-linear. The overall length of the taper should be several wavelengths of the signal in order to provide a smooth impedance transition.

Curved interface 542 between core region 533 having dielectric constant $\in$1 and core region 541 having dielectric constant $\in$2 causes a portion of an electromagnetic signal received on port 1 to be diverted to path 1, while another portion of the signal proceeds through curved interface 542 to port 2. The amount of signal diversion depends on the difference between dielectric constant $\in$1 and dielectric constant $\in$2. The radius, or angle, at which path 1 diverges from path 2 also affects how much signal is diverted to path 1.

As described above, a filtering effect occur when the electromagnetic wave of path 1 goes around the circular path 532 and rejoins the electromagnetic wave coming from port 1 on input DWG portion 530. Depending the frequency (or wavelength) of the electromagnetic wave and the length of the circular path 532, the signal will interfere constructively or destructively with the signal coming from port 1.

Figure 6:
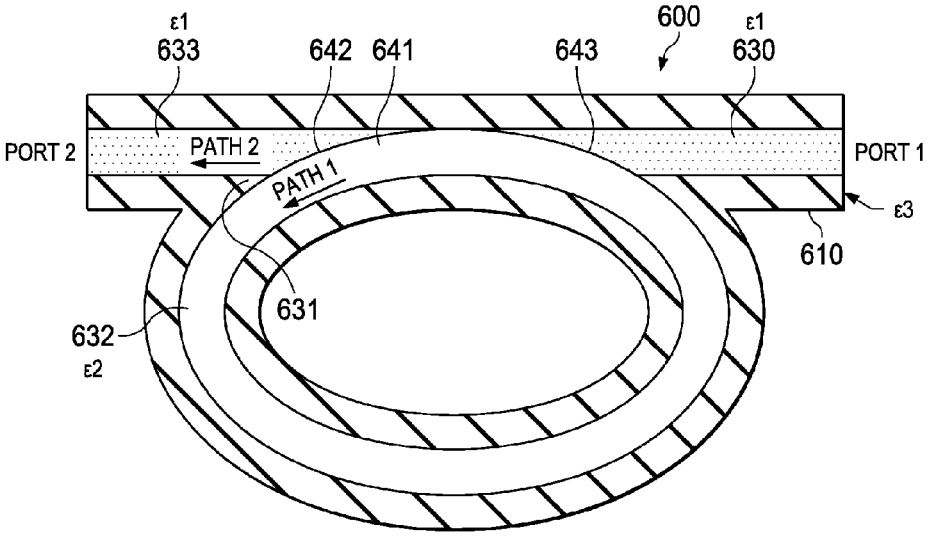

FIG. 6 illustrates an alternative embodiment of a waveguide frequency selector device 600, also referred to herein as "DWG filter 600". DWG filter 600 has an input DWG portion 630 that is configured to receive a high frequency signal launched into port 1. Input DWG 630 is bifurcated in region 631 to form a circular DWG portion 632 and an output DWG portion 633 that is configured to propagate a high frequency signal out of port 2. In order to cause a significant amount of signal to bifurcate through the bent portion of filter 600 and feed circular DWG portion 632, the signal filter may use two different materials for the core. In this example, the magnitude of the electromagnetic field in path 1 and path 2 is controlled by the selection of two different dielectric constant materials for the core. Core portions 630, 633 are implemented with a core material having dielectric constant $\in$1 and core portion 641 is implemented with a polymer having dielectric constant $\in$2. Cladding 610 has a dielectric constant $\in$3, which as will be explained in more detail below, has a value that is less than $\in$1 and $\in$2. In general, in order to produce a significant signal strength on path 1, the divider is designed with $\in$2>$\in$1 in order to overcome the tendency of the electromagnetic wave to keep moving straight from port 1 to port 2, similar to device 500.

In order to minimize the impedance mismatch between the different dielectric core materials, a taper or smooth transition regions 642, 643 is provided between the materials with dielectric constants ∈1 and ∈2. In this example, the taper is curvilinear; however, in another embodiment the taper may be non-linear. The overall length of the taper should be several wavelengths of the signal in order to provide a smooth impedance transition.

Figure 7:
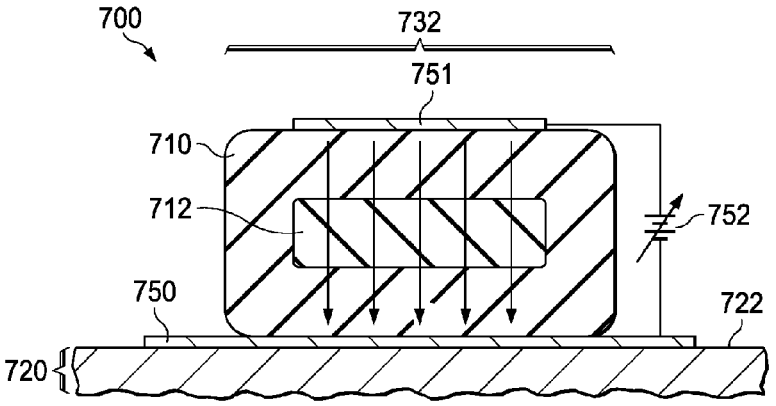
FIG. 7 is a cross section of a portion of a frequency selector illustrating a variable voltage field for tuning the dielectric.

FIG. 7 is a cross section of a portion of a frequency selector device 700 illustrating a variable voltage field for tuning the dielectric of core material 712, which is surrounded by cladding material 710. Filter device 700 may be similar to any of the filter devices described above.

The propagation velocity of an EM signal through a material is determined in part by the dielectric constant of the material. Therefore, the wavelength of the EM signal may be changed by changing the dielectric constant of the transmission media. As shown by equations (1) and (2), the filter characteristics of filter device 700 are determined by the wavelength of signals traversing the circular DWG portion 732.

It is known that the dielectric constant of several high dielectric constant materials may change in the presence of a DC electric field. Tunable dielectric materials are materials whose permittivity (more commonly called dielectric constant) can be varied by varying the strength of an electric field to which the materials are subjected. Even though these materials work in their paraelectric phase above the Curie temperature, they are conveniently called "ferroelectric" because they exhibit spontaneous polarization at temperatures below the Curie temperature. Tunable ferroelectric materials including barium-strontium titanate (BST) or BST composites have been reported. Strontium titanate may be used at low temperatures.

This technique may be applied to any of the feedback paths 232, 532, 632 described above, for example. In this example, device 700 is fabricated on a substrate 720, which may be flexible or rigid in different embodiments. An electrode 750 may be formed on a surface 722 of substrate 720. A matching electrode 751 may be formed on top of curved DWG portion 732. The electrodes 750, 751 may cover a portion or most of the circular feedback DWG portion 732. In another embodiment, the matching electrodes may be formed on the sides of circular DWG portion 732, rather than on the top and bottom, for example.

Dielectric core material 712 is a tunable high dielectric material, such as BST, Zinc oxide (ZnO), etc., for example. Alternatively, dielectric core material 712 may be a polymer that is doped with high dielectric particles, such as BST, ZnO, etc., for example. The particles may be nm or um sized, for example. A variable voltage source 752 may be connected across electrodes 750, 751 and used to tune the dielectric constant value of core material 712 and to thereby tune the filter characteristics of filter 700. Control logic may be coupled to the variable voltage source to control tuning of device 700.

Figure 8:
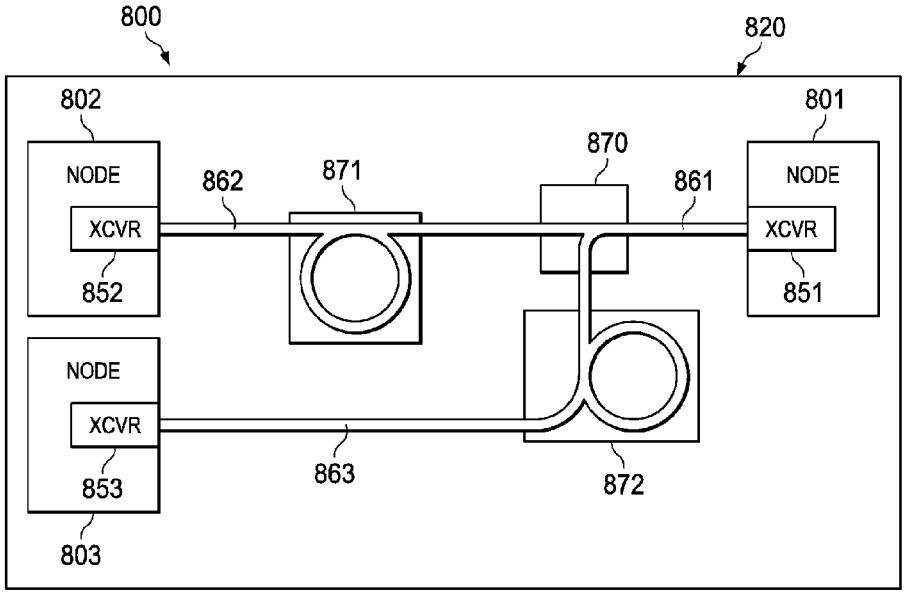
FIG. 8 is an example of a system in which waveguide frequency selectors are used on different branches.

FIG. 8 is an illustration of a system 800 that has at least three nodes 801, 802, and 803 that are interconnected with DWGs 861, 862, 863 using a signal divider 870 that are all formed on a substrate 820. An example signal divider is described in more detail in US patent application Ser. No. 14/498,512, filed Sep. 26, 2014, entitled "Dielectric Waveguide Signal Divider", which is incorporated by reference herein. The three nodes may be a computing device and two peripheral devices or three computing devices, for example. The nodes may be any form of computing device, such as, but not limited to: a system on a chip (SOC), a rack mount, desk mount, or portable computer, a mobile user device such a notebook computer, a tablet computer, a smart phone, etc, for example. The nodes may be any type of peripheral device such as: a media storage device such as rotating or solid state disk drive, a modem or other interface to a high speed network, etc, for example. Each node may be an integrated circuit. All of the nodes may be mounted on a common circuit board substrate 820, for example. Alternatively, one or more of the nodes may be on separate substrates, for example.

DWG frequency selection device 871 may be used to select a particular signal frequency to provide to node 802, as described above in more detail. Similarly, DWG signal selection device 872 may be used to select a particular signal frequency to provide to node 803, as described above in more detail. In this example, filter device 871 may be similar to device 500 or 600, for example. Filter device 872 may be similar to device 200, for example. However, different configurations may be used in various implementations. Additional dividers 870 and filters 871, 872 may be used to connect to additional nodes, for example.

Each node 801, 802, 803 may be an SOC or may contain a PWB (printed wiring board) or other type substrate on which are mounted one or more integrated circuits that produce or receive a sub-terahertz signal that is coupled to a DWG using transceivers (XCVR) 851, 852, 853, for example. The manner of coupling between the IC and the DWG may be implemented using any of the techniques described in more detail in US Patent Publication number 2014-0285277, or later developed, for example.

Waveguides 861, 862, and 863 may be any form of flexible or rigid DWG as described in more detail below, for example. Various system embodiments may have more or fewer nodes interconnected with waveguides that are formed on a substrate, for example.

In some embodiments, one or more of segments 861-863 may have a metallic or otherwise conductive sidewalls, while one or more of segments 861-863 may be a dielectric waveguide in which the sidewall cladding is also a dielectric material having a lower dielectric constant value than the core region.

DWGs 861, 862, 863, signal divider 870, and filters 871, 872 may all be formed on a single substrate 820 using an ink jet or another three dimensional printing process, for example. In another embodiment DWGs 861, 862, 863, signal divider 870, and filters 871, 872 may all be formed on a single substrate using PWB fabrication techniques with plating and etching, for example. In another embodiment, DWGs 861, 862, 863, signal divider 870, and filters 871, 872 may be formed using diffusion techniques to produce different dielectric constant values in a polymer material, for example.

In some embodiments, substrate 820 may be a silicon, or other semiconductor or insulator material, or a single integrated circuit that includes multiple functional nodes, often referred to as a system on a chip (SoC). In that case, the SoC may include an antenna or other coupling structure in a node such as node 801, an antenna, or other coupling structure in a second node such as node 802, with a DWG coupled between the two nodes formed directly on the SoC substrate.

A layer-by-layer additive fabrication technique such as inkjet-printing may be used to manufacture these steps of different dielectric constant polymers by printing the DWG directly onto a substrate, as will be explained in more detail below.

Several configurations of dielectric waveguides and methods for making them will now be described in more detail.

In each example, a frequency selector device may be formed as part of the waveguide as described above.

Figure 9:
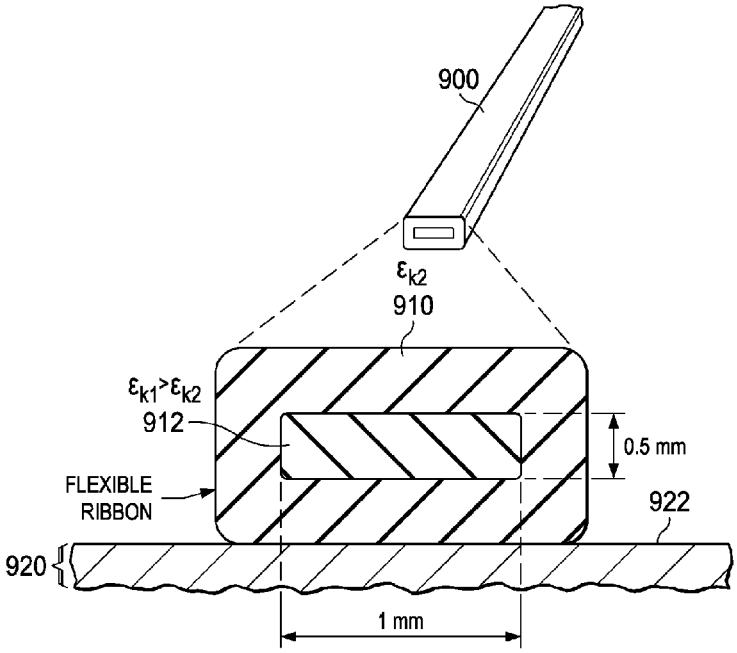
FIGS. 9-11 are illustrations of example waveguides.

FIG. 9 illustrates a DWG 900 that is configured as a thin flexible ribbon of a core dielectric material surrounding by a dielectric cladding material. The core dielectric material has a dielectric constant value ∈k1, while the cladding has a dielectric constant value of ∈k2, where ∈k1 is greater than ∈k2. In this example, a thin rectangular ribbon of the core material 912 is surrounded by the cladding material 910. For sub-terahertz signals, such as in the range of 130-150 gigahertz, a core dimension of approximately 0.5 mm×1.0 mm works well. DWG 900 may be fabricated conformably onto surface 922 of substrate 920 using the inkjet printing process or other 3D printing process described in more detail below.

In this example, dielectric clad DWG 900 is fabricated on a surface 922 of a substrate 920, as will be explained in more detail below. This substrate may range from an integrated circuit (IC) die, a substrate in a multi-chip package, a printed circuit board (PCB) on which several ICs are mounted, etc., for example. The substrate may be any commonly used or later developed material used for electronic systems and packages, such as: silicon, ceramic, acrylic glass, fiberglass, plastic, metal, etc., for example. The substrate may be as simple as paper, for example.

Figure 10:
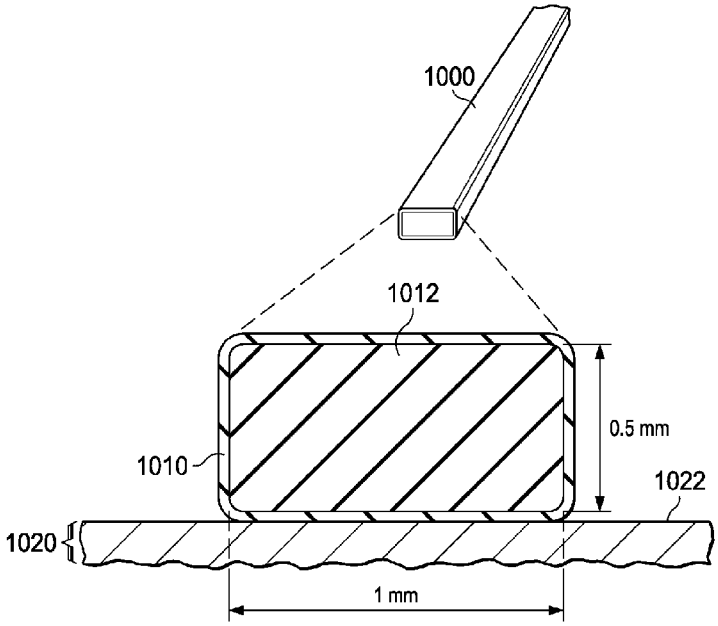

FIG. 10 illustrates a metallic, or other conductive material, clad DWG 1000 that is configured as a thin ribbon of the core material 1012 surrounding by the metallic cladding material 1010. For sub-terahertz signals, such as in the range of 130-150 gigahertz, a core dimension of approximately 0.5 mm×1.0 mm works well.

In this example, metallic clad DWG 1000 is fabricated on a surface 1022 of a substrate 1020. This substrate may range from an integrated circuit (IC) die, a substrate in a multi-chip package, a printed circuit board (PCB) on which several ICs are mounted, etc., for example. The substrate may be any commonly used or later developed material used for electronic systems and packages, such as: silicon, ceramic, acrylic glass, fiberglass, plastic, metal, etc., for example. The substrate may be as simple as paper, for example.

Figure 11:
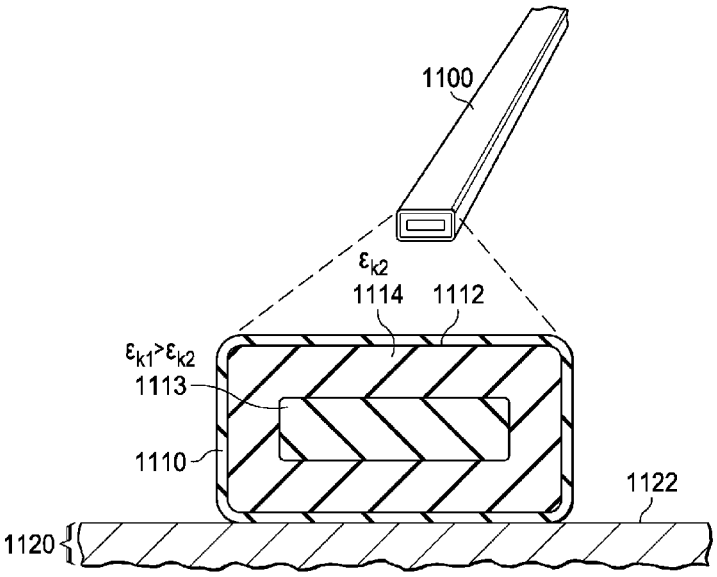

FIG. 11 illustrates a metallic, or other conductive material, clad DWG 1100 that is configured as a thin ribbon of the core 1112 surrounding by the metallic cladding material 1110. In this example, core 1112 is comprised of a thin rectangular ribbon of the core material 1113 that is surrounded by a second layer of core material 1114 to form a graded core 1112. Core region 1113 has a dielectric constant value of ∈k1, while core region 1114 has a dielectric constant value of ∈k2, where ∈k1>∈k2. In another embodiment, graded core 1112 may comprise more than two layers (e.g. n layers) of core material, with each layer having a different relative dielectric constant value ranging from relative permittivity of ∈r1-∈rn, for example. In another example, the graded core may be implemented in such a manner that the dielectric constant value gradually varies from a higher value in the center to a lower value at the outside edge. In this manner, a graded core may be provided that tends to confine the sub-THz frequency signal to the core material and thereby reduce cutoff effects that may be produced by the metallic cladding, for example.

In this example, metallic clad DWG 1100 is fabricated on a surface 1122 of a substrate 1120. This substrate may range from an integrated circuit (IC) die, a substrate in a multi-chip package, a printed circuit board (PCB) on which several ICs are mounted, etc., for example. The substrate may be any commonly used or later developed material used for electronic systems and packages, such as: silicon, ceramic, acrylic glass, fiberglass, plastic, metal, etc., for example. The substrate may be as simple as paper, for example.

Figure 12:
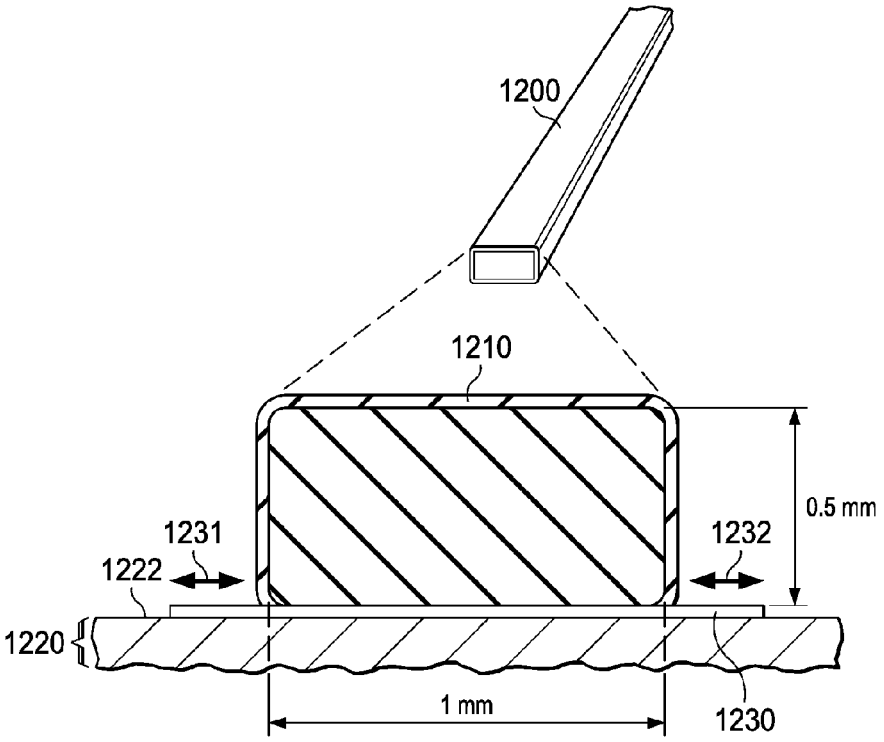
FIG. 12 illustrates another embodiment of any of the waveguides of FIGS. 9-11.

FIG. 12 illustrates another embodiment 1200 of any of the waveguides of FIGS. 9-11. In this example, waveguide 1200 is fabricated on a surface 1222 of a substrate 1220. This substrate may range from an integrated circuit (IC) die, a substrate in a multi-chip package, a printed circuit board (PCB) on which several ICs are mounted, etc., for example. The substrate may be any commonly used or later developed material used for electronic systems and packages, such as: silicon, ceramic, acrylic glass, fiberglass, plastic, metal, etc., for example. The substrate may be as simple as paper, for example.

For a metallic clad waveguide, such as those illustrated in FIGS. 10-11, a bottom portion of waveguide 1200 may be formed by a conductive layer 1230 that may extend along surface 1222 beyond a footprint of waveguide 1200, as indicated at 1231, 1232, for example. For a non-metallic DWG such as illustrated in FIG. 9, a bottom portion of waveguide 1200 may be formed by a dielectric layer 1230 that may extend along surface 1222 beyond a footprint of waveguide 1200, as indicated at 1231, 1232, for example. In either case, the extent of regions 1231, 1232 may be minimal, or they may cover an extended portion of surface 1222, or even the entire surface 1222, for example. Conductive layer 1230 may be metallic or may be a conductive non-metallic material, for example. Cladding layer 1210 may be formed over the top and sides of the core region and coupled to layer 1230 to form a cladding layer that completely surrounds the core region.

Embodiments of the invention may be implemented using any of the dielectric core waveguides described above, for example. In each embodiment, one or more frequency selection devices may be provided in order to allow multiple frequency signals to be transmitted across a single DWG.

The various dielectric core waveguide configurations described above may be fabricated using a printing process, such as an inkjet printer or other three dimensional printing mechanism. Fabrication of three dimensional structures using ink jet printers or similar printers that can "print" various polymer materials is well known and need not be described in further detail herein. For example, see "3D printing," Wikipedia, Sep. 4, 2014. Printing allows for the rapid and low-cost deposition of thick dielectric and metallic layers, such as 0.1 um-1000 um thick, for example, while also allowing for fine feature sizes, such as 20 um feature sizes, for example. Standard integrated circuit (IC) fabrication processes are not able to process layers this thick. Standard macroscopic techniques, such as machining and etching, typically used to manufacture dielectric waveguides and metallic structures may only allow feature sizes down to 1 mm, for example. These thicker printed dielectric and metallic layers on the order of 100 nm-1 mm which are made possible by inkjet printing enable waveguide operation at Sub-THz and THz frequencies. Previously optical frequencies could be handled using standard semiconductor fabrication methods while lower frequencies may be handled using large metallic waveguides; however, there was a gap in technology for fabricating waveguides for THz signals. Printing the waveguides directly onto the chip/package/board mitigates alignment errors of standard waveguide assemblies and simplifies the packaging process.

Figure 13:
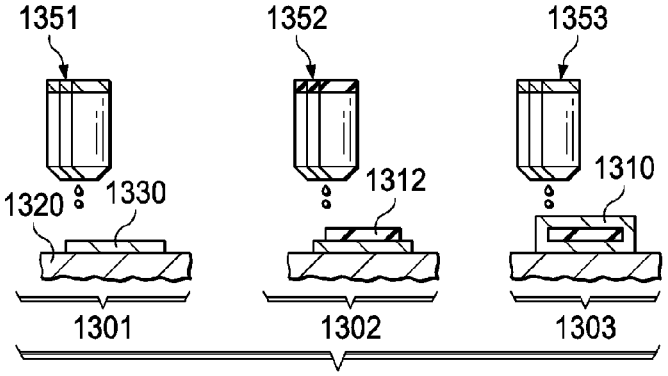
FIGS. 13-14 are process flow diagrams illustrating fabrication of various configurations of waveguides using a three dimensional printing process.

FIG. 13 is a process flow diagram illustrating fabrication of a waveguide with a dielectric core similar to FIGS. 9 and 10 using an ink jet printing process. In process step 1301, an inkjet printing mechanism illustrated at 1351 deposits a bottom layer 1330 on a top surface of a substrate 1320 using a known printing process. This bottom layer will form a bottom surface of the waveguide. Bottom layer 1330 may be a dielectric layer for forming a dielectric waveguide similar to DWG 900. Similarly, bottom layer 1330 may be a conductive layer for forming a conductive waveguide similar to DWG 1000. Bottom layer 1330 may be configured so that it only extends across the bottom region of the wave guide, as illustrated in FIGS. 9-10, or it may be configured to extend beyond the walls of the waveguide, as illustrated in FIG. 12. Bottom layer 1330 extends the length of the waveguide and conforms to the top surface of substrate 1320.

In another embodiment, bottom layer 1330 may be prefabricated on the substrate; for example, it may be a conductive layer that is laminated on the surface of substrate 1320. In this example, unneeded portions of the conductive layer may be removed by etching, for example, or by other known fabrication techniques for creating patterned features on a substrate. In another embodiment, bottom layer 1330 may be formed by diffusion of a layer onto substrate 1320, or by sputtering a layer onto substrate 1320, or by flooding the surface of substrate 1320 with a liquid or paste, etc., for example. In another embodiment, a stamped metal or dielectric shape may be laminated or otherwise affixed to substrate 1320 to form bottom layer 1330

In process step 1302, a core member 1312 is formed by printing a dielectric material to form the core of the waveguide. Multiple passes of print-head 1352 may be required to obtain a desired thickness for core 1312. The printed dielectric may be composed of any dielectric material which can be deposited in thick layers, such as polymers, oxides, etc., for example. Additional passes of print-head 1352 may be performed using materials having different dielectric constant values to form the bifurcation region 531, 631, referring back to FIGS. 5 and 6 respectively, for example.

During process step 1303, a conformal cladding coating is applied by print-head 1353 to cover the top and sides of the waveguide. In this manner, core 1312 is enclosed with a conductive cladding 1310 or a dielectric cladding to form a waveguide. Various conductive materials that can be printed in this manner may be used to form coating 1310, such as: a conductive ink with metallic filler, a conductive polymer formed by ionic doping, carbon and graphite based compounds, conductive oxides, etc., for example. Similarly, a dielectric material similar to base layer 1330 may be used to form the cladding for a non-conductive DWG, for example.

Figure 14:
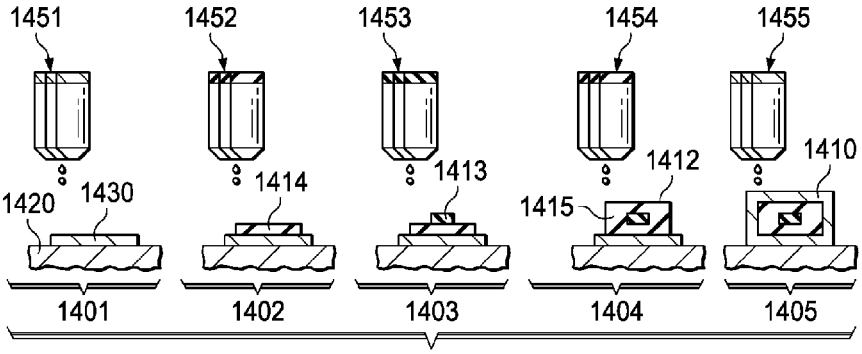

FIG. 14 is a process flow diagram illustrating fabrication of a metallic waveguide with a dielectric core similar to FIG. 11 using an ink jet printing process. In this example, a bottom layer 1430 is formed on a top surface of substrate 1420 by a print-head 1451 during process step 1401, in a similar manner as described above with regard to FIG. 13. A first core layer 1414 is formed by print-head 1452 during process step 1402 in a similar manner as described above.

During process step 1403, a region 1413 of the core is formed by print-head 1453 using a dielectric material that has a different dielectric constant than the material used for layer 1414. Then, in step 1404 another layer 1415 of dielectric material is applied by print-head 1454 to complete the core member of the waveguide. In this example, three layers 1414, 1413, and 1415 are used to form core member 1412. In this example, layer 1413 has a relative dielectric constant value $\in r1$ that is greater than the relative dielectric constant value $\in r2$ of layers 1414, 1415. As discussed above, in this manner is graded core may be formed that allows the sub-THz signal to be more confined within the region of the dielectric core.

Multiple passes of print-head 1453 may be required to obtain a desired thickness for core 1413. The printed dielectric may be composed of any dielectric material which can be deposited in thick layers, such as polymers, oxides, etc., for example. Additional passes of print-head 1453 may be performed using materials having different dielectric constant values to form the bifurcation region 531, 631, referring back to FIGS. 5 and 6 respectively, for example.

In another embodiment, additional layers may be used to form core member 1412 using a range of relative permittivity of $\in r1$-$\in rn$, for example.

During process step 1405, a printed conductive coating is applied by print-head 1455 to cover the top and sides of the waveguide. In this manner, core 1412 is enclosed with a conductive cladding 1410 to form a waveguide, as discussed in more detail above.

For all of the waveguide embodiments described above, the waveguides may be printed arbitrarily long in a desired pattern in the plane of the substrate. However, the length of the DWG may be limited by the "attenuation budget" available since the transceiver must allow for a determined attenuation of the signal between transmission signal (Tx) and reception signal (Rx). The maximum length of the DWG depends on several factors, including: the material of the DWG, its attenuation, isolation properties bending loss and number of curves, etc., for example.

Printed waveguides may conform to the surface topology of the substrate. If the substrate is flexible, the waveguide may also be flexible as long as the materials used to print the waveguide are also flexible.

In another embodiment, the dielectric core may be formed in a such a manner that the dielectric core has a dielectric constant value that varies over at least two values along the longitudinal extent of the dielectric core. This may be done by printing different materials along the extent of the dielectric core, for example. This may be useful for matching impedance of the waveguide to another waveguide, for example.

Typically, using a lithographic process to form the dielectric core would produce essentially vertical sidewalls on the dielectric core. Deposition of a metallic material to cover the dielectric core may be difficult when the sides of the dielectric core are vertical. However, using an inkjet process to form the dielectric core and controlling the surface tension of the ink allows the slope, or angle, of the sidewalls of the printed waveguide to be controlled. Thus, the sidewalls of the dielectric core may be formed with a slight inward slope, or may be formed perfectly vertical, depending on the needs of the next processing step. In this manner, deposition of the metallic sidewalls may be improved. This may not be an issue in other 3D printing processes, however.

Figure 15:
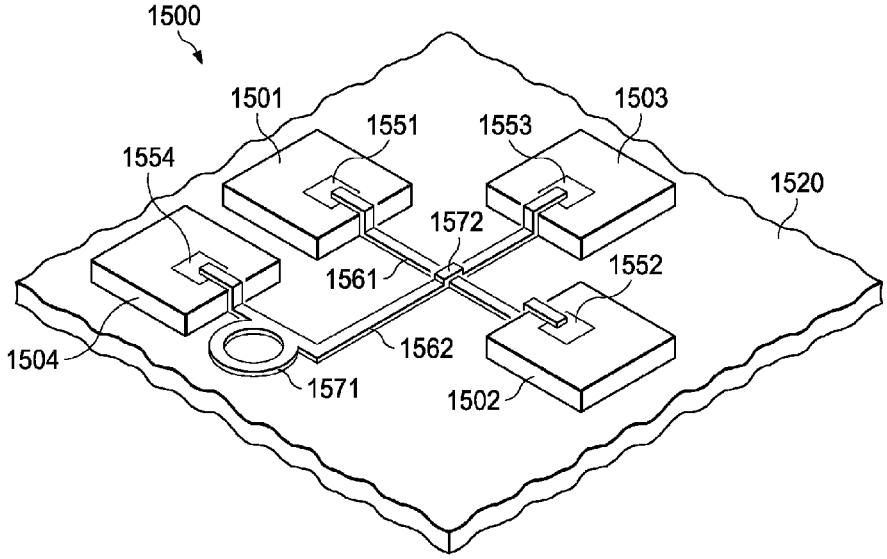
FIG. 15 is an illustration of a system illustrating various aspects of conformal waveguides.

FIG. 15 is an illustration of a system 1500 illustrating various aspects of conformal waveguides. In this example, four nodes 1501, 1502, 1503, 1504 with transceivers 1551, 1552, 1553, 1554 are mounted or otherwise formed on a surface of substrate 1520, as described in more detail above. Transceiver 1551 is coupled to transceiver 1552 by a waveguide 1561 that is also formed on the surface of substrate 1520 as described in more detail above. Likewise, transceiver 1553 is coupled to transceiver 1554 by a waveguide 1562 that is also formed on the surface of substrate 1520 as described in more detail above. One or more filters 1571 may be included to pass or reject a particular signal frequency, as discussed above in more detail.

As described in more detail above, waveguides 1561, 1562 may be formed directly on the surface of substrate 1520 using an inkjet process or other form of 3D printing.

This process allows the wave guides to be formed on a chip die of each node and to then follow over the edge of each die an onto the surface of substrate 1520. In a similar manner, one waveguide, such as 1562, may be routed over the top of another waveguide, such as 1561, as indicated at 1572, for example.

In some embodiments, substrate 1520 may be a single integrated circuit that includes multiple functional nodes in a single SoC. In that case, the SoC may include an antenna or other coupling structure in each node such as node 1501-1504, with one or more DWGs coupled between the two nodes formed directly on the SoC substrate. In this manner, a wide degree a freedom is available to route multiple waveguides on a surface of the substrate, and to cross over other waveguides or other physical features that are present on the surface of the substrate.

As shown by the above descriptions and examples, multiple electronic devices may be easily interconnected to provide sub-terahertz communication paths between the electronic devices by using the techniques described herein.

Printable metallic waveguides on top of a chip, package, or board may be processed onto nearly any substrate (silicon, acrylic glass, plastic, paper, etc. . . . ). Printed dielectric layers on the order of 100 nm-1 mm which are made possible by inkjet printing enable waveguide operation at Sub-THz frequencies; previously only optical frequencies could be reached using standard fabrication methods. A metallic or otherwise conductive shell provides isolation over standard dielectric waveguides.

Thus, extremely low-cost and low-loss sub-THz signal routing waveguides may be printed onto nearly any substrate. Printing the waveguides directly onto the chip/package/board mitigates alignment errors of standard waveguide assemblies and simplifies the packaging process.

Figure 16:
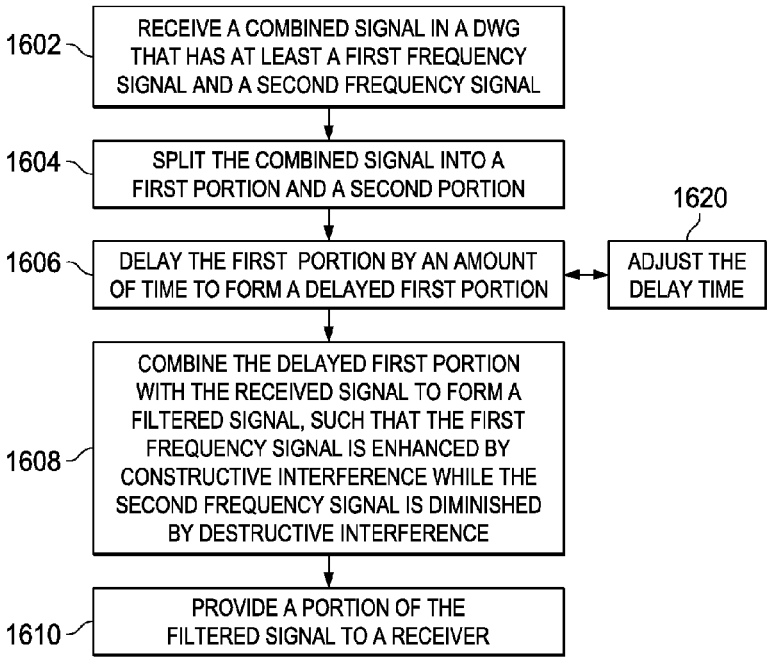
FIG. 16 is a flow chart illustrating frequency selection in a waveguide system.

FIG. 16 is a flow chart illustrating a method for filtering signals on a dielectric waveguide. A combined signal is received at step 1602 on an input port of the DWG, wherein the combined signal includes at least a first frequency signal with a first wavelength and a second frequency signal with a second wavelength. Each wavelength has a corresponding time period for the duration of one wavelength being transmitted through the DWG.

The combined signal is split at step 1604 into a first portion and a second portion. This may be done by bifurcating the signal as described with regard to bifurcation region 231, 531, 631, etc., for example. In one embodiment, the bifurcation region may be formed by two DWG curved segment branches that each have a similar curvature radius. In another embodiment, the bifurcation region may be formed by a curved interface between two regions of different dielectric constant, as illustrated by 531, 631, for example.

The first portion of the combined signal is delayed at step 1606 by an amount of time to form a delayed first portion. This may be done by passing the first portion of the signal through a DWG feedback loop or delay line such as loop 232, 532, 632, etc., for example. As discussed above with regard to equation (1) and (2), the delay time may be selected to be approximately an integer multiple of the first wavelength time period, or an integer multiple plus ½ of the second wavelength time period.

The delayed first portion is combined at step 1608 with the received signal to form a filtered signal such that the first frequency signal is enhanced by constructive interference while the second frequency signal is diminished by destructive interference. This may be done by merging the circular DWG feedback loop with the input portion of the DWG, as described above in more detail.

A portion of the filtered signal is provided at step 1610 to a receiver. As described above in more detail, the amplitude of the second frequency signal is attenuated in the filtered signal. As described above, a portion of the filtered signal may be split by bifurcation region 231, 531, 631, etc., for example, and provided to an output port by path 2 and thereby to a receiver that is coupled to output port 2.

In some embodiments, the delay may be adjusted at step 1620 to tune the filter characteristics. This may be done by adjusting the dielectric constant of the circular feedback loop by impressing a variable DC field across the dielectric core material of the circular feedback loop, for example.

Figure 17:
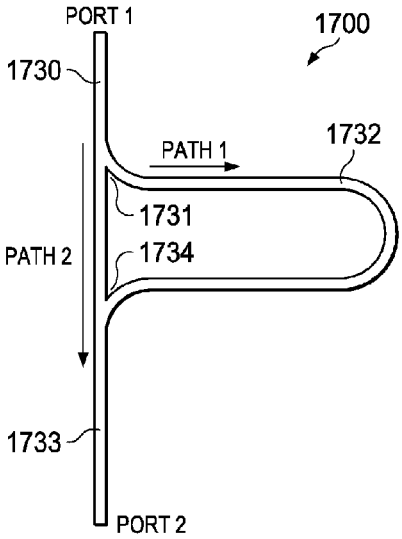
FIGS. 17-18 are illustrations of other embodiments of a waveguide frequency selector.

FIG. 17 is an illustration of another embodiment of a waveguide frequency selector device 1700. In this figure, just the core is illustrated for simplicity; however, selector device 1700 is constructed in a similar manner as described above in more detail. DWG filter 1700 has an input DWG portion 1730 that is configured to receive a high frequency signal launched into port 1. Input DWG 1730 is bifurcated in region 1731 to form a delay-line DWG portion 1732 and an output DWG portion 1733. In this example, output DWG portion 1733 may be approximately straight rather than curved. In order to cause a significant amount of signal to bifurcate through the bent portion of filter 1700 and feed delay-line DWG portion 1732, the signal filter may use two different materials for the core, as described in more detail with regard to FIGS. 5 and 6.

As described above, filtering effects occur when the electromagnetic wave of path 1 goes through the delay path 1732 and rejoins the electromagnetic wave coming from port 1 on input DWG portion 1730 at joining region 1734. Depending on the frequency (or wavelength) of the electromagnetic wave, the length of the delay path 1732, and the length of path 2 between the bifurcation region 1731 and joining region 1734, the signal will interfere constructively or destructively with the signal coming from port 1.

In some embodiments, the dielectric of path 1 or path 2 may be tuned using an electric field, as described in more detail with regards to FIG. 7.

This DWG filter device is bidirectional, in that a signal may be received at either port 1 or and/or at port 2.

Figure 18:
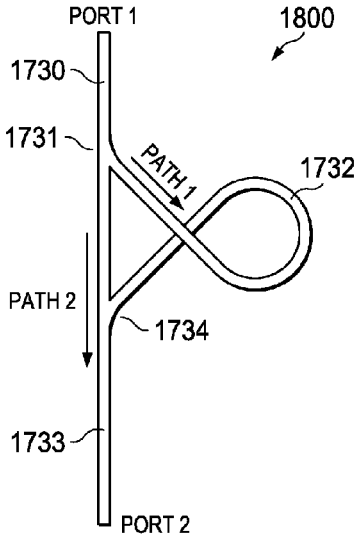

FIG. 18 is another bidirectional embodiment of a waveguide frequency selector device 1800 that operates in a similar manner to FIG. 17. In this example, note that after diverging from path 2 at bifurcation region 1731, path 1 crosses over a portion of DWG 1732 as that portion of DWG 1732 returns to joining region 1734. In this manner, a more compact layout may be realized, for example.

Other embodiments in which an input DWG is bifurcated to create two different length paths that are then rejoined to produce constructive and/or destructive interference based on a difference in delay time between the two paths may be easily derived using the principles described herein.

Embodiments allow sending information in different frequencies or channels across a DWG and filtering them at the other end of the DWG interconnect. This can be accomplished with a device that may be passive or active. Examples of passive devices are described in FIGS. 2, 5, and 6. An active device may include an active modulation of the dielectric constant of the circular DWG portion by means a variable DC field, for example.

Other Embodiments

While the invention has been described with reference to illustrative embodiments, this description is not intended to be construed in a limiting sense. Various other embodiments of the invention will be apparent to persons skilled in the art upon reference to this description. For example, while a dielectric waveguide has been described herein, another embodiment may use a metallic or non-metallic conductive material to form the top, bottom, and sidewalls of the wave guide, such as: a conductive polymer formed by ionic doping, carbon and graphite based compounds, conductive oxides, etc., for example. As used herein, the term "conductive waveguide" refers to a waveguide having either metallic or non-metallic conductive sidewalls.

While a circular DWG feedback loop was described herein, the feedback loop may be oval, elongated, square with rounded corners, etc., for example.

While waveguides with polymer dielectric cores have been described herein, other embodiments may use other materials for the dielectric core, such as ceramics, glass, etc., for example.

The substrate on which a dielectric core waveguide is formed may be rigid or flexible, planar or non-planar, smooth or irregular, etc., for example. Regardless of the topology of the substrate, the dielectric core waveguide may be formed on the surface of the substrate and conform to the topology of the surface by using the additive processes described herein.

While dielectric cores with a rectangular cross section are described herein, other embodiments may be easily implemented using the printing processes described herein. For example, the dielectric core may have a cross section that is rectangular, square, trapezoidal, cylindrical, oval, or many other selected geometries. Furthermore, the processes described herein allow the cross section of a dielectric core to change along the length of a waveguide in order to adjust impedance, produce transmission mode reshaping, etc., for example.

In some embodiments, the substrate may be removed after forming a waveguide using the inkjet printing or other 3D printing process by dissolving the substrate with an appropriate solvent or melting a heat sensitive substrate, for example. In this manner, a free standing waveguide that may have a complicated shape may be formed using the ease of fabrication and optional material variations available as described herein.

The dielectric core of the conductive waveguide may be selected from a range of approximately 2.4-12, for example. These values are for commonly available dielectric materials. Dielectric materials having higher or lower values may be used when they become available.

While formation of a conductive waveguide by directly printing the waveguide onto the substrate using a layer-by-layer additive fabrication technique such as inkjet-printing is described herein, other additive techniques such as screen-printing, flexographic printing, or 3D printing may also be used.

While DWGs and metallic or otherwise conductive waveguides are described herein, the inkjet and 3D printing techniques described herein may also be used to form other forms of waveguides, micro-coax, etc., for example that conform to a surface of a substrate.

Certain terms are used throughout the description and the claims to refer to particular system components. As one skilled in the art will appreciate, components in digital systems may be referred to by different names and/or may be combined in ways not shown herein without departing from the described functionality. This document does not intend to distinguish between components that differ in name but not function. In the following discussion and in the claims, the terms "including" and "comprising" are used in an open-ended fashion, and thus should be interpreted to mean "including, but not limited to . . . ." Also, the term "couple" and derivatives thereof are intended to mean an indirect, direct, optical, and/or wireless electrical connection. Thus, if a first device couples to a second device, that connection may be through a direct electrical connection, through an indirect electrical connection via other devices and connections, through an optical electrical connection, and/or through a wireless electrical connection.

Although method steps may be presented and described herein in a sequential fashion, one or more of the steps shown and described may be omitted, repeated, performed concurrently, and/or performed in a different order than the order shown in the figures and/or described herein. Accordingly, embodiments of the invention should not be considered limited to the specific ordering of steps shown in the figures and/or described herein.

It is therefore contemplated that the appended claims will cover any such modifications of the embodiments as fall within the true scope and spirit of the invention.

What is claimed is:

1. A method for filtering signals on a dielectric waveguide, the method comprising:

receiving a combined signal on the dielectric waveguide (DWG), wherein the combined signal comprises at least a first frequency signal with a first wavelength and a second frequency signal with a second wavelength;

splitting the combined signal into a first portion and a second portion, wherein splitting the combined signal is performed using two curved DWG branches with similar curvature radius;

delaying the first portion of the combined signal by an amount of delay time to form a delayed first portion;

joining the delayed first portion with the received combined signal to form a filtered signal such that the first frequency signal is enhanced by constructive interference while the second frequency signal is diminished by destructive interference; and providing a portion of the filtered signal to a receiver, whereby the amplitude of the second frequency signal is attenuated in the filtered signal.

2. The method of claim 1, wherein the amount of delay time is approximately equal to an integer multiple of a time of one period of the first wavelength.

3. The method of claim 1, wherein the amount of delay time is approximately equal to an integer multiple plus ½ of a time of one period of the second wavelength.

4. The method of claim 1, wherein delaying the first portion of the combined signal is performed using a DWG delay line, wherein the length of the DWG delay line is approximately equal to an integer multiple of the wavelength of the first frequency signal.

5. A method for filtering signals on a dielectric waveguide, the method comprising:

receiving a combined signal on the dielectric waveguide (DWG), wherein the combined signal comprises at least a first frequency signal with a first wavelength and a second frequency signal with a second wavelength;

splitting the combined signal into a first portion and a second portion, wherein splitting the combined signal is performed using a curved or an angled interface in the DWG core with a different dielectric constant value on each side of the curved or angled interface;

delaying the first portion of the combined signal by an amount of delay time to form a delayed first portion;

joining the delayed first portion with the received combined signal to form a filtered signal such that the first frequency signal is enhanced by constructive interference while the second frequency signal is diminished by destructive interference; and providing a portion of the filtered signal to a receiver, whereby the amplitude of the second frequency signal is attenuated in the filtered signal.

6. A dielectric waveguide (DWG) system comprising:

a DWG frequency selector, wherein the frequency selector comprises:

a dielectric wave guide having an input portion that terminates in a bifurcation region to form a first branch and a second branch, wherein the first branch forms a delay line that rejoins the second branch;

a substrate having a surface, wherein the dielectric waveguide is formed on the surface of the substrate, wherein the waveguide includes:

a conformal base layer formed on the surface of the substrate; and two spaced apart sidewalls and a conformal top layer connected to the base layer to form a longitudinal core region; and wherein at least one of the conformal base layer, sidewalls, and conformal top layer is metallic.

7. A method for filtering signals on a dielectric waveguide, the method comprising:

receiving a combined signal on the dielectric waveguide (DWG), wherein the combined signal comprises at least a first frequency signal with a first wavelength and a second frequency signal with a second wavelength;

splitting the combined signal into a first portion and a second portion;

delaying the first portion of the combined signal by an amount of delay time to form a delayed first portion, wherein delaying the first portion of the combined signal is performed using a DWG delay line, wherein the length of the DWG delay line is approximately equal to an integer multiple of the wavelength of the first frequency signal;

adjusting the delay time amount by adjusting a value of the dielectric constant of the DWG delay line;

joining the delayed first portion with the received combined signal to form a filtered signal such that the first frequency signal is enhanced by constructive interference while the second frequency signal is diminished by destructive interference; and providing a portion of the filtered signal to a receiver, whereby the amplitude of the second frequency signal is attenuated in the filtered signal.

8. The method of claim 7, wherein adjusting the dielectric constant is performed by adjusting a magnitude of a voltage field across the DWG delay line.

9. A dielectric waveguide (DWG) system comprising:

a DWG frequency selector, wherein the frequency selector comprises:

a dielectric wave guide having an input portion that terminates in a bifurcation region to form a first branch and a second branch, wherein the first branch forms a delay line that rejoins the second branch, wherein the first branch has a curved portion having a first radius within the bifurcation region; and wherein a second branch has a curved portion having a radius approximately equal to the first radius within the bifurcation region.

10. The system of claim 9, further comprising a substrate having a surface, wherein the waveguide is formed on the surface of the substrate, wherein the waveguide comprises:

a conformal base layer formed on the surface of the substrate; and two spaced apart sidewalls and a conformal top layer connected to the base layer to form a longitudinal core region.

11. The waveguide of claim 10, wherein at least one of the conformal base layer, sidewalls, and conformal top layer is metallic.

12. The system of claim 10, further comprising:

a transmitting device mounted on the surface of the substrate being coupled to the waveguide and operable to launch a radio frequency (RF) signal into the frequency selector; and a receiving device mounted on the surface of the substrate being coupled to the waveguide and operable to receive a portion of the RF signal from the frequency selector.

13. The system of claim 10, wherein the conformal base layer extends beyond the sidewalls.

14. A dielectric waveguide (DWG) system comprising:

a DWG frequency selector, wherein the frequency selector comprises:

a dielectric wave guide having an input portion that terminates in a bifurcation region to form a first branch and a second branch, wherein the first branch forms a delay line that rejoins the second branch, wherein the first branch has a curved portion having a first dielectric value within the bifurcation region; wherein a second branch has a second dielectric constant value within the bifurcation region separated from the first branch by an interface plane, such that the first dielectric value is greater than the second dielectric value.

15. The system of claim 14, further comprising a substrate having a surface, wherein the waveguide is formed on the surface of the substrate, wherein the waveguide comprises:

a conformal base layer formed on the surface of the substrate; and two spaced apart sidewalls and a conformal top layer connected to the base layer to form a longitudinal core region.

16. The waveguide of claim 15, wherein at least one of the conformal base layer, sidewalls, and conformal top layer is metallic.

17. The system of claim 15, wherein the conformal base layer extends beyond the sidewalls.

18. The system of claim 15, further comprising:

a transmitting device mounted on the surface of the substrate being coupled to the waveguide and operable to launch a radio frequency (RF) signal into the frequency selector; and a receiving device mounted on the surface of the substrate being coupled to the waveguide and operable to receive a portion of the RF signal from the frequency selector.

* * * * *